US005828179A

United States Patent [19]

Lee

[11] Patent Number: 5,828,179

[45] Date of Patent: Oct. 27, 1998

[54] DEVICE FOR PREVENTING A LAMP FROM IGNITING A COVER SUCH AS A CURTAIN

[75] Inventor: Fu-kuo Lee, Taipei, Taiwan

[73] Assignee: Mei-jen Chang, Taiwan

[21] Appl. No.: 787,901

[22] Filed: Jan. 23, 1997

[51] Int. Cl.[6] ..... H05B 37/02

[52] U.S. Cl. ..... 315/159; 315/156; 315/157; 315/119; 250/214 AL

[58] Field of Search ..... 315/119, 120, 315/125, 149, 150, 151, 156, 157, 158, 159; 250/214 AL, 214 B, 214 C

[56] References Cited

U.S. PATENT DOCUMENTS 3,777,225 12/1973 Dixon ..... 315/159

*Primary Examiner*—Benny Lee
*Assistant Examiner*—David H. Vu
*Attorney, Agent, or Firm*—Holland & Hart LLP

[57] ABSTRACT

An anti-burn device which can prevent a floor lamp from burning material covering thereon is disclosed. The anti-burn device includes a photoresistor and a detecting control circuit. The photoresistor has a photo-sensitive surface receiving light reflected back to the floor lamp. When the photoresistor receives the reflected light, the detecting control circuit will cut off the power supply to the halogen bulb. Therefore, burning of the material draped on or against the floor lamp can be avoided.

5 Claims, 4 Drawing Sheets

DEVICE FOR PREVENTING A LAMP FROM IGNITING A COVER SUCH AS A CURTAIN

FIELD OF THE INVENTION

The present invention relates to an anti-burn device, and more particularly to an anti-burn device which prevents a floor lamp from burning a material thereon.

FIELD OF RELATED ART

A conventional floor lamp has a structure as shown in FIG. 5, the floor lamp comprises a base 90, a column 91 level connected with the base 90 for supporting a lamp housing 92. The lamp housing 92 has a lamp socket 93 therein for receiving a halogen bulb 94. When the halogen bulb 94 is turned on, light will be sent out upwardly and then reflected by a ceiling to obtain decorative and illuminating effect.

Though this conventional floor lamp can obtain a decorative and a illuminating effects, it has a disadvantage that it may be unsafe because the halogen bulb 94 used in the floor lamp will generate a high temperature, which can reach to 400° C. If combustible material, for example, a window curtain, rests on or is adjacent to the lamp housing, the high temperature of the halogen bulb 94 may burn the curtain and cause a fire.

The present invention provides an improved anti-burn device for a floor lamp to mitigate and/or obviate the aforementioned problems.

SUMMARY OF THE INVENTION

One object of the present invention is to provide a fire safeguard for a floor lamp which can prevent the floor lamp from burning material thereon.

In accordance with one aspect of the present invention, an anti-burn device for a floor lamp comprises a photoresistor and a detecting control circuit. The photoresistor has a photo-sensitive surface for receiving a return light from the floor lamp. The detecting control circuit includes a detecting trigger unit and an electron switch unit. The detecting trigger unit has a transistor having a base electrode connected to the photoresistor via a delayed diode and an emitting electrode connected to the electron switch unit. The electron switch unit comprises a first transistor, a second transistor, a third transistor, a relay and a plurality of resistors. The third transistor has a base electrode connected to an output of the detecting trigger unit and a collecting electrode connected to the relay to control the power supply of the floor lamp. The second transistor has a base electrode connected to the output of the detecting trigger unit and a collecting electrode connected to a base electrode of the third transistor. The first transistor has a collecting electrode connected to the output of the detecting trigger circuit and to the base electrode of the third transistor.

In accordance with another aspect of the present invention, the electron switch unit further includes a reset switch connected between the base electrode of the second transistor and ground.

In accordance with a further aspect of the present invention, the detecting control circuit further includes a buffer unit connected between the detecting trigger unit and the electron switch unit, said buffer unit comprising a diode, a resistor and a capacitor.

Other objects, advantages and novel features of the invention will become more apparent from the following detailed description when taken in conjunction with the accompanying drawings.

DETAILED DESCRIPTION OF PREFERRED EMBODIMENT

Figure 1:
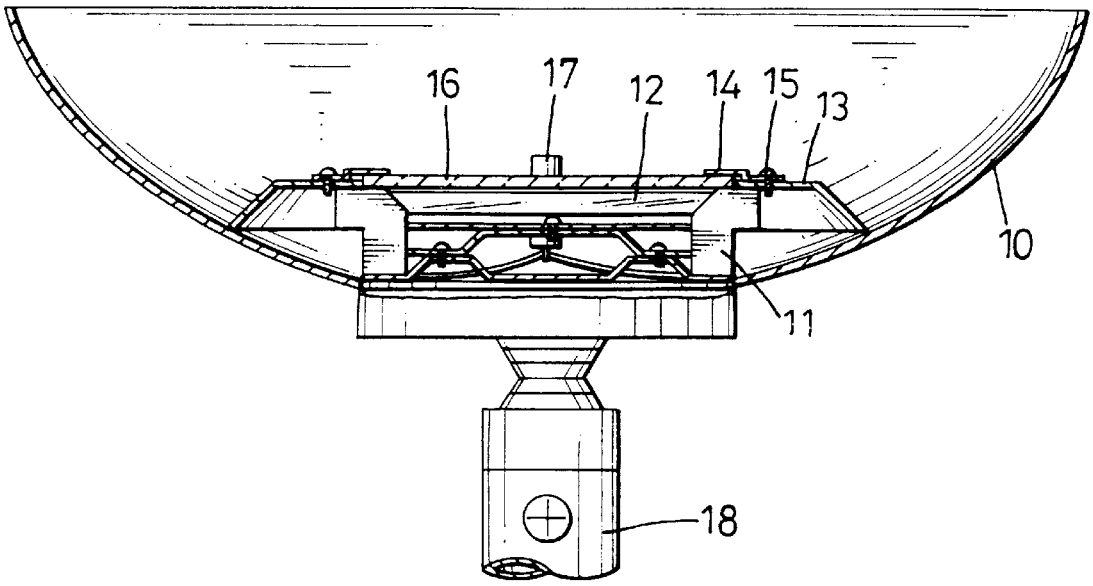
FIG. 1 is a first cross-sectional view showing a lamp housing of a floor lamp in accordance with the present invention.

Referring to FIG. 1, a floor lamp in accordance with the present invention has a basic configuration similar to that of the conventional lamp. The floor lamp has a bowl-like lamp housing 10. A pair of opposed lamp sockets 11 are disposed at a lower portion in the housing 10 for receiving a halogen bulb 12. The lamp housing 10 further has a circular bottom plate 13 arranged around the halogen bulb 12 such that the pair of sockets 11 project beyond a plane of the bottom plate 13. A pair of strips 14 are mounted on the bottom plate 13 by screws 15. The pair of strips 14 are pivotable when the screws 15 are released. A heat-resistant disc 16 covers the pair of sockets 11 and is retained by the pair of strips 14. The disk 16 can be mounted onto the sockets 11 by means of the screws 15.

Figure 2:
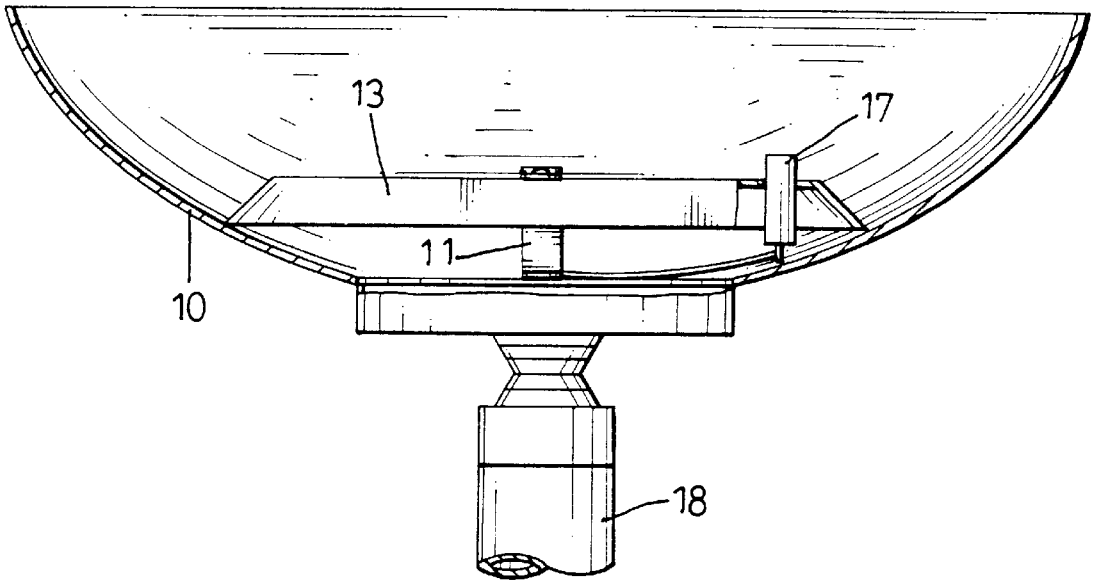
FIG. 2 is a second cross-sectional view showing the lamp housing of the floor lamp in accordance with the present invention.

Referring to FIG. 2, the bottom plate 13 further defines a hole (not numbered) therein to receive a photoresistor 17. The photoresistor 17 has a photo-sensitive surface facing away from the bottom 13 for receiving a reflected light which is sent from the halogen bulb 12 and then reflected by a ceiling. The photoresistor 17 and the pair of lamp sockets 11 are respectively connected to a detecting control circuit.

Figure 3:
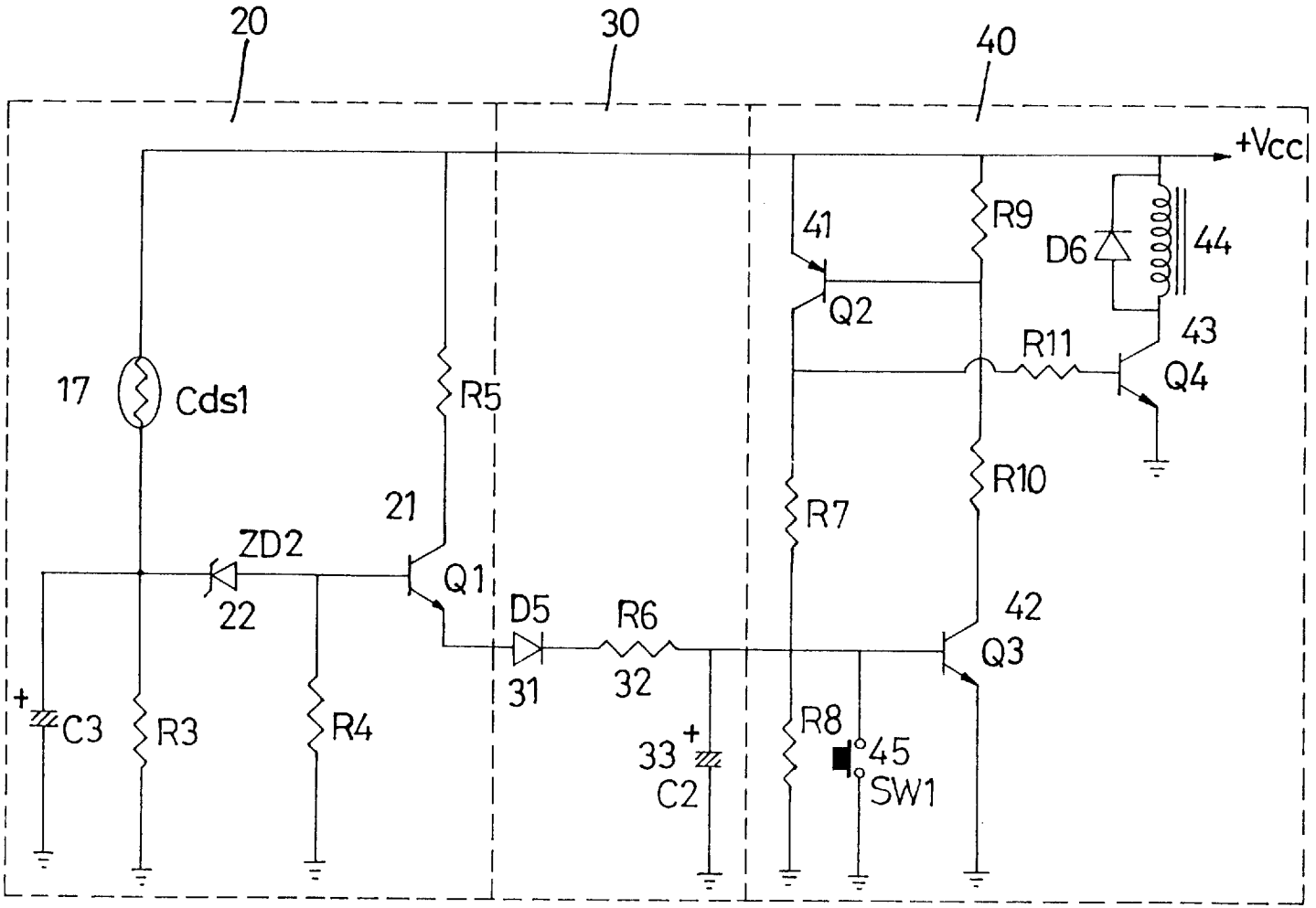
FIG. 3 is a circuit diagram of a detecting control circuit for the floor lamp in accordance with the present invention.

The detecting control circuit can be disposed at an appropriate position in the bottom plate 13 or within a column 18 supporting the lamp housing 10. Referring to FIG. 3, the detecting control circuit includes a detecting trigger unit 20 and an electron switch unit 40. The detecting trigger unit 20 has a transistor 21. A base electrode of the transistor 21 is connected to the photoresistor 17 via a delayed diode 22 to determine whether the transistor 21 is turned on, depending on the varied resistance when the photoresistor 17 receives the return light from the ceiling. An emitting electrode of the transistor is connected to the electron switch unit 40 via a buffer unit 30. The buffer unit 30 comprises a diode 31, a resistor 32 and a capacitor 33 and is provided for preventing a malfunction of the electron switch unit 40. The electron switch unit 40 comprises a first transistor 41, a second transistor 42, a third transistor 43, a relay 44 and a plurality of resistors and capacitors. The first transistor 41 is a PNP transistor and has a base electrode connected to a collecting electrode of the second transistor 42 and a collecting electrode connected to a base electrode of the third transistor 43. The second transistor 42 is a NPN transistor which has a base electrode connected to an output of the buffer unit 30. Between the base electrode of second transistor 42 and a ground there is a reset switch 45. The third transistor 43 is a NPN transistor and has the base electrode connected to the output of the buffer unit 30 and a collecting electrode connected to an exciting coil of the relay 44. A switch contact of the relay 44 controls the power supply of the halogen bulb 12.

Figure 4:
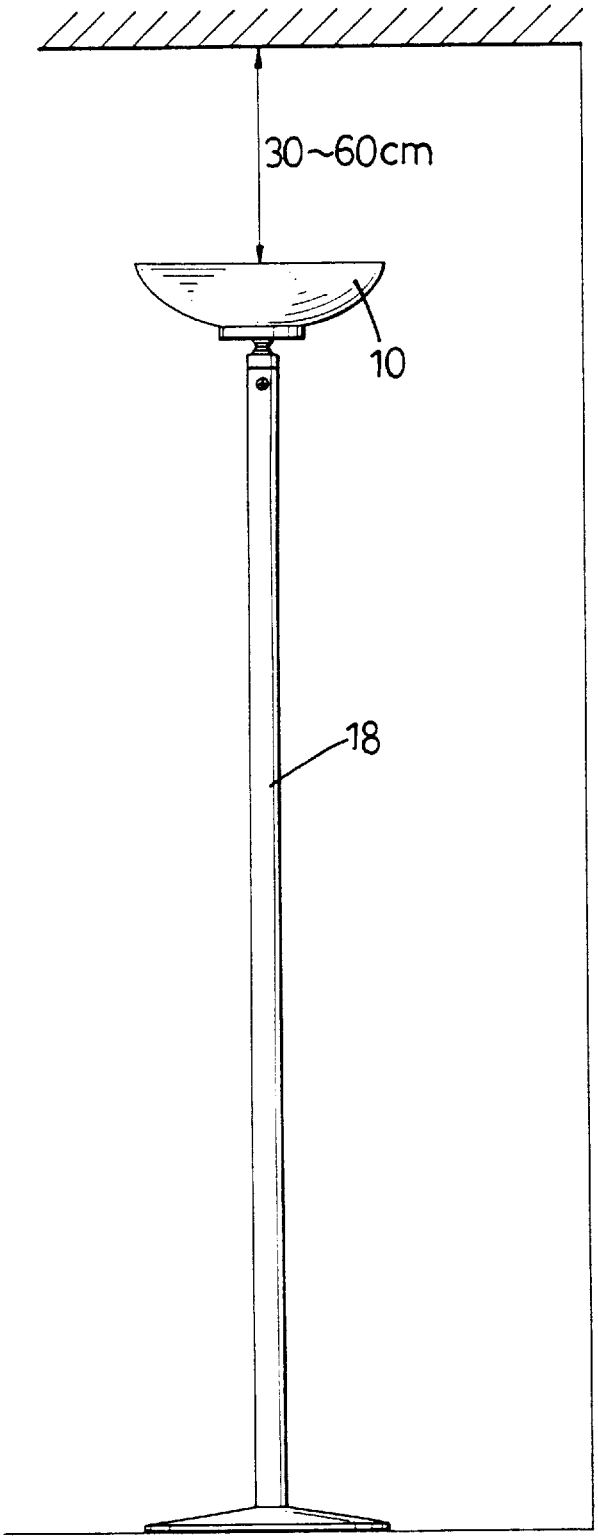
FIG. 4 is a schematic view showing an embodiment of the floor lamp in accordance with the present invention.
Figure 5:
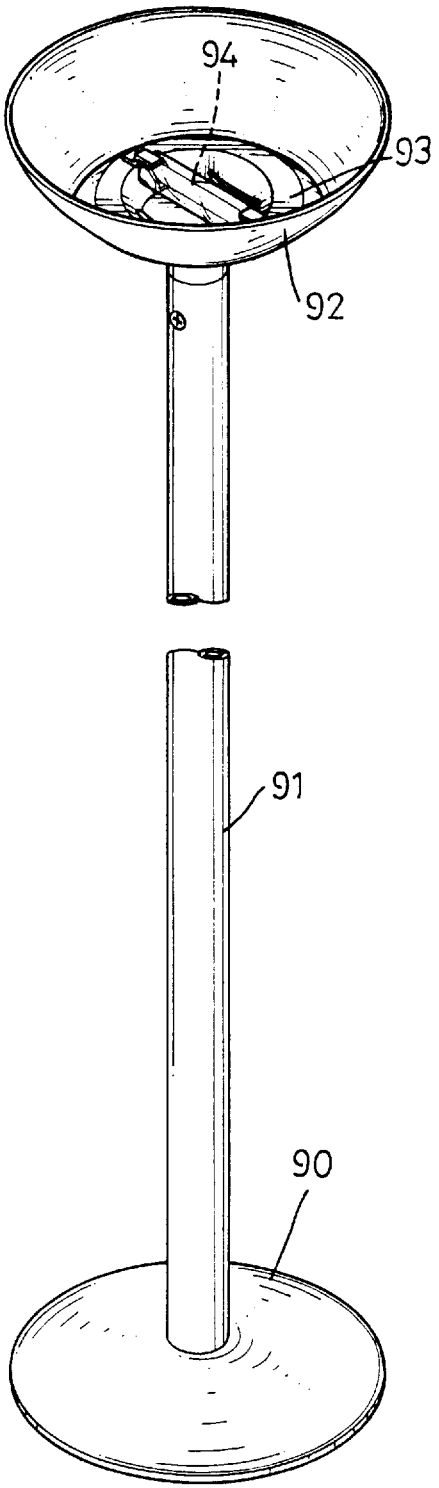
FIG. 5 PRIOR ART
FIG. 5 is a perspective view showing a conventional floor lamp.

Referring to FIG. 4, when the floor lamp is used, the lamp housing 10 is preferably located at a distance of 30–60 centimeters from the ceiling. In this case, this distance is far enough to disable the photoresistor 17 to receive the return light from the ceiling. In this case, the base voltage of the transistor 21 of the detecting trigger unit 20 is zero. The emitting electrode of the transistor 21 becomes low. Therefore, the base voltage of the third transistor 43 of the electron switch unit 40 is low level and the relay 44 does not operate and the halogen bulb 12 is maintained in the TURN-ON state.

If the lamp housing 10 is covered by a window curtain or other materials, the curtain will form a specular surface in a close distance over the halogen bulb 12. Therefore the photoresistor 17 receives reflected light from the curtain and becomes low resistance. In this case, the base voltage of the transistor 21 of the detecting trigger unit 20 is re tained at about 8 volts by the delayed diode 22. Then the emitting electrode of the transistor turns to high level and actuates the electron switch unit 40 after the high level is confirmed by the buffer unit 30. In this way, the input of the electron switch unit 40 is high level so that the third transistor 43 is turned on. Then the switch contact of the relay 44 will cut off the power supply of the halogen bulb 12 to prevent burning of the curtain. The cut-off state of the power supply of the halogen bulb 12 can be reset by the reset switch 45. When the reset switch 45 is pressed to be turned on, the second base electrode of the second transistor 42 is grounded, while the third base electrode of the third transistor 43 will be low level. However, if the photoresistor 17 is still in the low resistance status, i.e., the photoresistor 17 still receives light reflected from the specular surface of the curtain, the reset operation will be invalid.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An anti-fire device for a lamp comprising:

a photoresistor having a photo-sensitive surface for receiving light that is reflected back to the lamp from a surface that is illuminated when the lamp is energized;

a detecting control circuit including a detecting trigger unit and an electron switch;

said detecting trigger unit having a transistor having a base electrode connected to the photoresistor via a delayed diode, and having an emitter electrode that comprises an output of the detecting trigger unit;

said electron switch unit having a first transistor, a second transistor, a third transistor and a relay;

said first transistor having a collector electrode connected to the output of the detecting trigger unit;

said second transistor having a base electrode connected to the output of the detecting trigger unit;

said third transistor having a base electrode connected to the output of the detecting trigger unit;

said second transistor having a collector electrode connected to a base electrode of said first transistor; and said third transistor having a collector electrode connected to the relay to control an energizing power supply of the lamp.

2. An anti-fire device for a lamp as claimed in claim 1, wherein said electron switch unit further includes a reset switch connected between the base electrode of a second transistor and the ground.

3. An anti-fire device for a lamp as claimed in claim 1, wherein said detecting control circuit further includes a buffer unit connected between the detecting trigger unit and the electron switch unit, said buffer unit comprising a diode, a resistor and a capacitor.

4. An anti-fire device as claimed in claim including:

a source of transistor operating potential;

a source of reference potential;

resistance means connecting said collector electrode of said first transistor, said base electrode of said second transistor, and said base electrode of said third transistor to said source of reference potential;

said first transistor having an emitter electrode connected to said source of transistor operating potential;

resistance means connecting said collector electrode of said second transistor and said base electrode of said first transistor to said source of transistor operating potential;

said third transistor having a collector electrode connected through said relay to said source of transistor operating potential; and said third transistor having an emitter electrode connected to said source of reference potential.

5. Anti-fire apparatus for a lamp comprising:

a photoresistor having a photo-sensitive surface for receiving light that is reflected back to the lamp from a surface that is illuminated when the lamp is turned-on;

a transistor operating potential;

a reference potential;

a detecting control circuit including a detecting trigger unit and an electron switch;

said detecting trigger unit having a transistor having a base electrode connected to said photoresistor, having a collector electrode connected to said transistor operating potential, and having an emitter electrode that comprises an output of said detecting trigger unit;

said electron switch unit having a first transistor, a second transistor, a third transistor, and a relay that is operable to turn-off the lamp when the relay is energized;

said first transistor having a collector electrode connected to said output of said detecting trigger unit, an emitter electrode connected to said transistor operating potential, and a base electrode connected to said transistor operating potential and to a collector electrode of said second transistor;

said second transistor having a base electrode connected to said output of the detecting trigger unit, and having an emitter electrode connected to said reference potential; and said third transistor having a base electrode connected to said output of said detecting trigger unit, having a collector connected to said transistor operating potential via said lamp-off relay, and having an emitter electrode connected to said reference potential.

* * * * *